US009719319B2

(12) United States Patent
Doane

(10) Patent No.: US 9,719,319 B2
(45) Date of Patent: Aug. 1, 2017

(54) DISINTEGRATING PACKER SLIP/SEAL

(71) Applicant: BAKER HUGHES INCORPORATED, Houston, TX (US)

(72) Inventor: James C. Doane, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 504 days.

(21) Appl. No.: 14/306,636

(22) Filed: Jun. 17, 2014

(65) Prior Publication Data

US 2015/0361758 A1 Dec. 17, 2015

(51) Int. Cl.
*E21B 33/129* (2006.01)
*E21B 23/01* (2006.01)

(52) U.S. Cl.
CPC ..... *E21B 33/129* (2013.01); *E21B 23/01* (2013.01)

(58) Field of Classification Search
CPC .. E21B 33/1208; E21B 33/1212; E21B 33/12; E21B 33/1216; E21B 23/00; E21B 23/01
See application file for complete search history.

(56) References Cited

U.S. PATENT DOCUMENTS

| | | | | |
|---|---|---|---|---|
| 3,385,679 | A * | 5/1968 | Current | E21B 33/1216 428/579 |
| 5,701,954 | A | 12/1997 | Kilgore et al. | |
| 5,944,102 | A | 8/1999 | Kilgore et al. | |
| 6,378,606 | B1 | 4/2002 | Swor et al. | |
| 6,481,497 | B2 | 11/2002 | Swor et al. | |
| 2011/0136707 | A1 | 6/2011 | Xu et al. | |

* cited by examiner

*Primary Examiner* — Wei Wang
(74) *Attorney, Agent, or Firm* — Steve Rosenblatt

(57) ABSTRACT

An annularly shaped structure serves as a support and seal when pushed out on a ramp. A continuous seal in a groove is used on one or two sides to enhance sealing. A separate annular structure for sealing can be disposed adjacent to the shape having alternating longitudinal slots so that each structure is targeted to a different purpose. The structures disintegrate when made of a disintegrating material such as for example a controlled electrolytic material (CEM) so that removal of the barrier can occur after a treating operation such as fracturing where many such barriers are deployed. The slots have enlarged holes at their ends to reduce stress concentration that can lead to cracking.

53 Claims, 4 Drawing Sheets

DISINTEGRATING PACKER SLIP/SEAL

FIELD OF THE INVENTION

The field of the invention is removable barriers and more specifically barriers used in completions such as treating which includes fracturing, stimulation or acidizing that then are removed for further operations and where the barriers are retained with an annularly shaped expandable ring for grip and sufficient seal to allow pressure operations against the barrier.

BACKGROUND OF THE INVENTION

Barriers are used to isolate zones in a borehole to complete an operation. Some operations involve multiple spaced barriers that are sequentially deployed so that fluid at high pressures can be pumped into perforations to fracture the underground rock formation. In such applications the barriers need to redirect the pumped fluid into the perforations and complete sealing to the wellbore wall is desirable but not required. After all the intervals are sequentially treated the barriers need to be removed. Milling the barriers out is time consuming and creates the need for debris removal from the borehole.

Disintegrating materials such as controlled electrolytic materials have been used in barrier components for the purposes of minimizing or eliminating milling in some instances. Controlled electrolytic materials have been described in US Publication 2011/0136707 and related applications filed the same day. The related applications are incorporated by reference herein as though fully set forth.

Slip members referred to as barrel slips are described in U.S. Pat. No. 6,481,497 and U.S. Pat. No. 6,378,606 and are annular shapes alternatively scored longitudinally from opposing ends at spaced circumferential intervals and having multiple ramps internally to mate with a conforming shape to enlarge the diameter of the annular shape. This design had hardened inserts on an outer face that were there to penetrate the surrounding tubular for enhanced grip for the seal assembly located nearby. These barrel shapes were not intended to seal and the hardened inserts created a standoff for the annular shape keeping much of the shape away from the surrounding tubular wall to the extent that there were acceptable leak paths among the inserts that were closed off nearby with the seal assembly put in the sealing position against the surrounding tubular wall. These types of packers had to be either milled out or released in separate trips in the hole which was expensive. Such designs did not lend themselves to removal by dissolving or disintegrating as their focus was to hold differential pressures without leakage for a long period of time, such as many years.

U.S. Pat. No. 5,701,954 and U.S. Pat. No. 5,944,102 are a variation where the gripping surface is a series of serrations as opposed to small external bores where hardened inserts were affixed. In this design the serrations themselves were hardened but the basic alternating longitudinal serration design was similar.

These designs differ from the present invention where an annular structure with scores is deployed to do double duty as a seal and an anchor. Variations are contemplated where a continuous strip of sealing material can be placed on the interior and/or the exterior faces of the structure to enhance the sealing and gripping capability. Alternatively, an abutting annular shape for a seal can be placed adjacent to the scored annular shape that can do some sealing. A single ramp can be used to move both structures against the surrounding tubular. Drilled holes wider than the slots are placed at the slot ends to minimize stress concentration in that area and to prevent initiation of cracks. Another alternative is that the present invention could be manufactured from non-degradable materials. Also, the present invention could be used in combination with a conventional slip system. In this variation the present invention will only seal and the conventional slip system will grip. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

An annularly shaped structure serves as a support and seal when pushed out on a ramp. A continuous seal in a groove is used on one or two sides to enhance sealing. A separate annular structure for sealing can be disposed adjacent to the shape having alternating longitudinal slots so that each structure is targeted to a different purpose. The structures disintegrate when made of a disintegrating material such as for example controlled electrolytic material (CEM) so that removal of the barrier can occur after a treating operation such as fracturing where many such barriers are deployed. The slots have enlarged holes at their ends to reduce stress concentration that can lead to cracking.

DETAILED DESCRIPTION OF THE PREFERRED EMBODIMENT

Figure 1A:
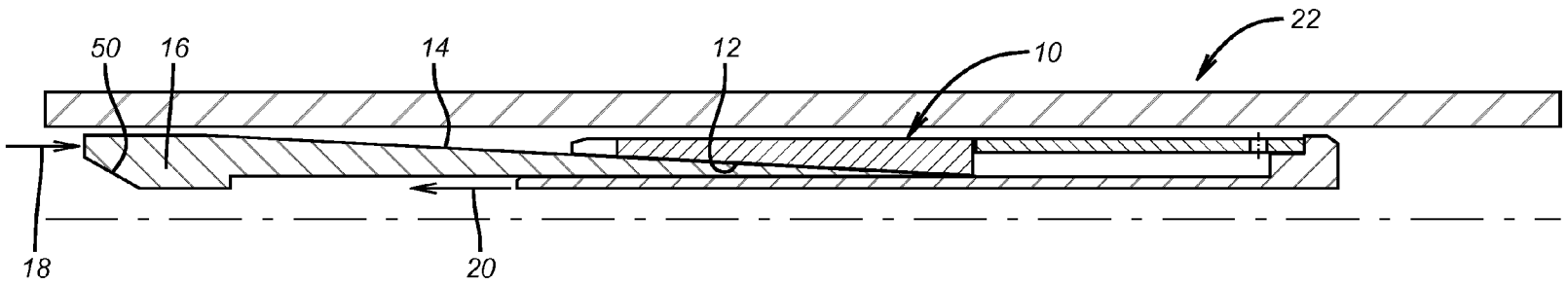
FIG. 1*a* is a section view of the slotted ring structure in a location for setting while still in the running in position.
Figure 1B:
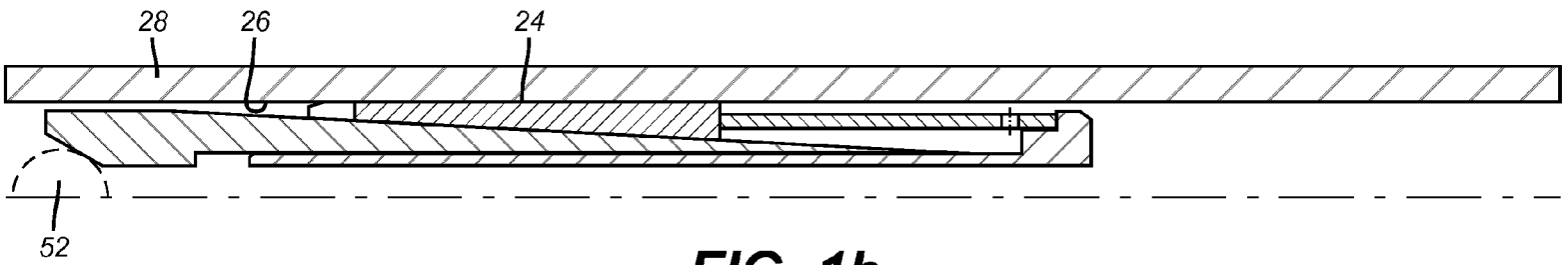
FIG. 1*b* is the view of FIG. 1*a* in the set position.

FIG. 1 shows the annular member 10 in section in the run in position. It has an inside surface 12 that slides along tapered surface 14 that preferably has a similar or identical slope. Cone 16 is held fixed by a setting tool schematically illustrated as arrows 18 and 20 to cause axial relative movement of the member 10 with respect to the cone 16 that is held by the setting tool that is not otherwise shown. Other portions of the mandrel of the barrier assembly 22 are also omitted to focus on the features of the present invention. The relative movement that is created by the setting tool represented by arrows 18 and 20 has the effect as shown in FIG. 1*b* of advancing the member 10 along surface 14 that is parallel to surface 12 until the outer surface 24 comes into contact with the interior wall 26 of the tubular 28 which in most applications is casing. Open hole applications in the borehole are also contemplated.

Figure 3:
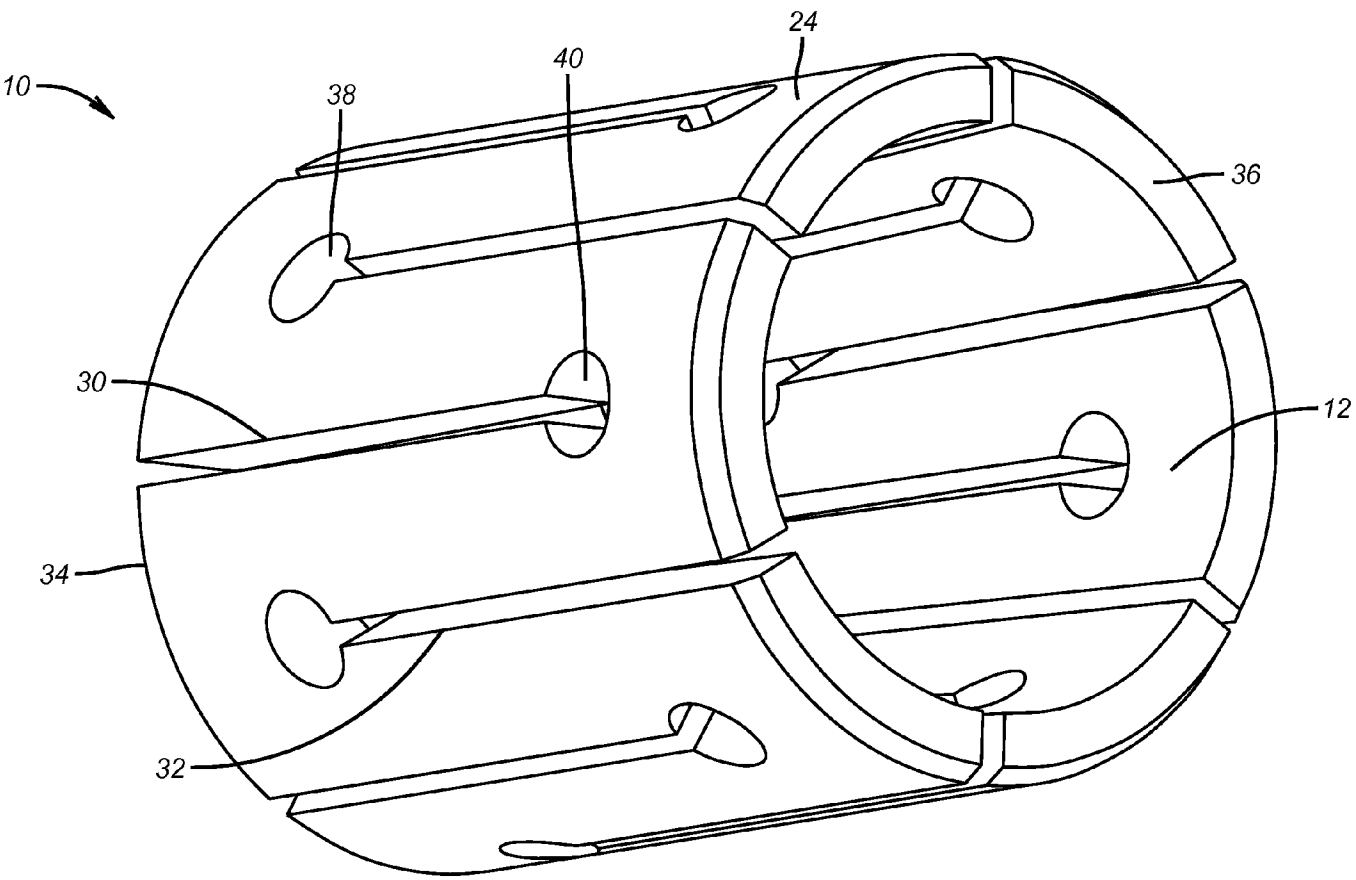
FIG. 3 is a view of the annular element in perspective.

FIG. 3 shows a view of the annular element in perspective. Opposed longitudinal slots 30 and 32 extend respectively from opposed ends 34 and 36 and terminate in oversized end bores 38 and 40 respectively. The end bores 38 and 40 reduce stress concentration at the ends of the slots 30 and 32 that alternate around the periphery in a repeating pattern that is preferably symmetrical. The presence of the alternating slots reduces the force required for expansion and promotes greater shape conformity of the member 10 when brought to the surrounding tubular which can be out of round or have some surface roughness. The bores 38 and 40 have diameters that are larger than the width of the slots 30 and 32. The inside surface 12 is tapered to conform to the slope of the tapered surface 14. The outer surface 24 moves generally in parallel relative to the tubular inner wall 26 until contact is made.

Figure 4:
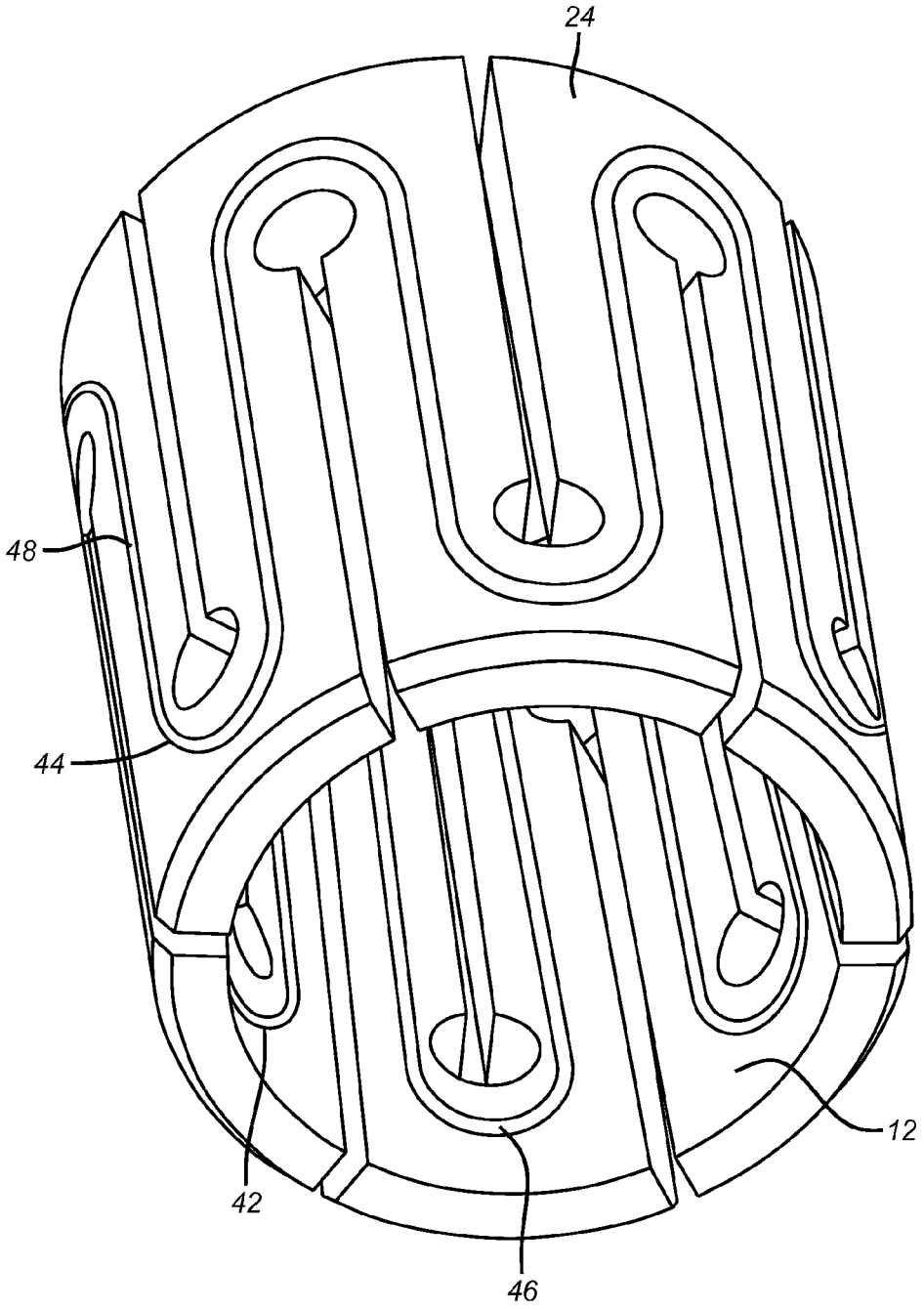
FIG. 4 is the view of FIG. 3 showing the addition of sealing on the interior and exterior faces.

FIG. 4 shows grooves 42 and 44 respectively on surfaces 12 and 24 with a seal member 46 and 48 being disposed substantially therein. While the FIG. 3 embodiment can be a seal from metal to metal contact with the surrounding tubular there could still be some leakage flow. In some applications such as fracturing some leakage flow is tolerated as long as the surface equipment has the capacity to deliver the needed volume at the needed pressure to fracture the perforations. However, the embodiment of FIG. 4 reduces if not eliminates leakage flow if that level of sealing is needed.

In another feature of the present invention the member 10 is made from a disintegrating material such as for example CEM so that in a multiple barrier completion where a ball 52 has been landed on a seat 50 such as in fracturing, the introduction of a reacting material in the borehole or the existing well fluids or both, can disintegrate the member 10 as well as the remaining barrier components such as the mandrel and the cone 16 so that little or nothing else is left. The balls 52 can also be brought to the surface with production or could themselves be disintegrated as the member 10 and other parts of the barrier of which it is a part are removed to permit subsequent operations such as production or injection.

As an alternative to a continuous seal in an associated groove, surfaces 12 and 24 can be coated with a sealing material. The coating can be interrupted for the slots and end bores or could also simply span them and either stretch as the member 10 expands and the slots 30 and 32 get wider or alternatively the coating can be scored or otherwise weakened to fail at the slots as expansion occurs and still serve well for sealing to the tubular surface 26 or the cone surface 14. The coating can be an elastomer or another resilient material that may or may not disintegrate when fluid such as an acid is introduced to initiate the disintegration process.

Figure 2A:
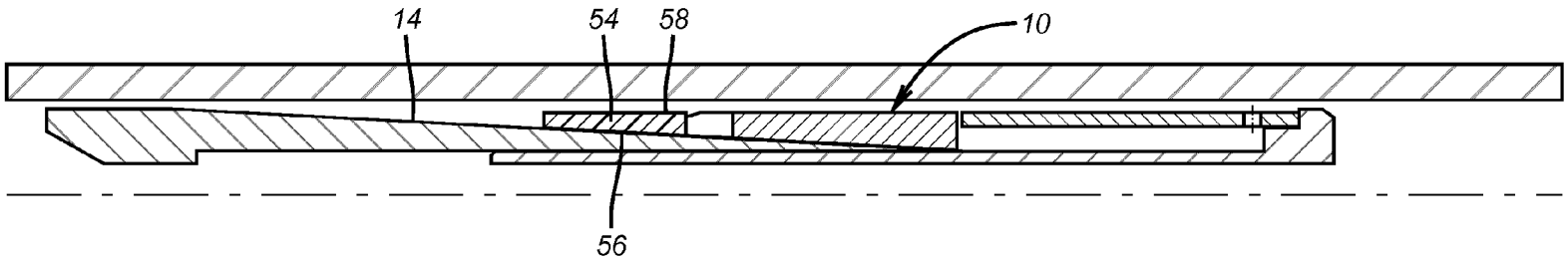
FIG. 2*a* is the view of FIG. 1*a* with a sealing wedge added.
Figure 2B:
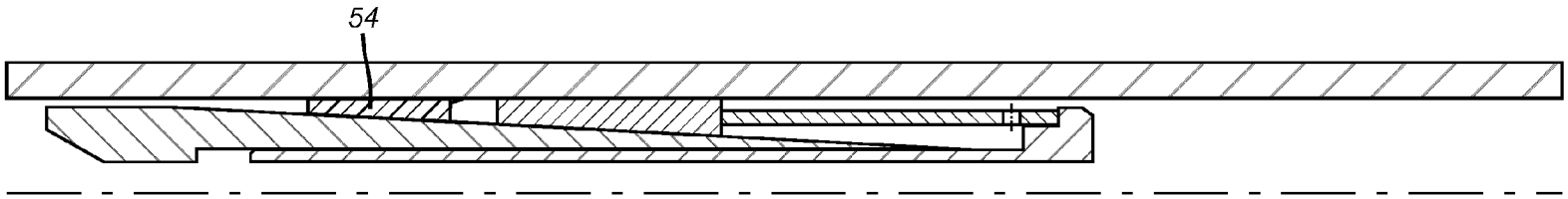
FIG. 2*b* is the view of FIG. 2*a* in the set position.

FIGS. 2*a* and 2*b* is an alternative to FIGS. 1*a* and 1*b*. A separate tapered ring 54 that has a tapered inside surface 56 and a cylindrical outer surface 58 is disposed on surface 14 abutting the member 10. In this manner, the member 10 acts as an anchor and a substantial seal but should additional sealing be needed or in situations where even minimal leakage under differential pressure loading is not desired, then the tapered ring 54 can be used to enhance sealing. The ring 54 can be made of a resilient or/and degradable material such as rubber or it can be made of a disintegrating material such as for example CEM if complete barrier disintegration is needed. In other respects the design of FIGS. 2*a* and 2*b* functions the same as described above for FIGS. 1*a* and 1*b*.

The above description is illustrative of the preferred embodiment and many modifications may be made by those skilled in the art without departing from the invention whose scope is to be determined from the literal and equivalent scope of the claims below:

I claim:

1. A barrier for subterranean use in a borehole, comprising:

a mandrel having at least one tapered surface;

a movable annularly shaped member having opposed ends and circumferentially alternating slots that begin at the opposed ends and extend longitudinally;

said member movable relatively with respect to said at least one tapered surface to contact a borehole wall with a smooth outer surface thereof that extends for a length from one end of said opposed ends to the other end of said opposed ends for substantial sealing so that applied differential pressure loading on said member the barrier can be contained to perform a treating operation.

2. The barrier of claim 1, wherein:

said member anchors to the borehole wall.

3. The barrier of claim 2, wherein:

said member is made of a selectively degrading material so that structural integrity of said member is undermined in a predetermined time for removal of said member from a location where said member was set against the borehole wall.

4. The barrier of claim 3, wherein:

said member is made of a controlled electrolytic material.

5. The barrier of claim 2, wherein:

said member comprises a sealing element that substantially covers said outer surface.

6. The barrier of claim 5, wherein:

said continuous sealing element is made of a resilient degradable material so that structural integrity of said member is undermined in a predetermined time for removal of said member from a location where said member was set against the borehole wall.

7. The barrier of claim 2, wherein:

said member comprises a sealing element that substantially covers an inner surface of said member.

8. The barrier of claim 7, wherein:

said continuous sealing element is made of a resilient degradable material so that structural integrity of said member is undermined in a predetermined time for removal of said member from a location where said member was set against the borehole wall.

9. The barrier of claim 2, wherein:

at least some of said slots have end bores.

10. The barrier of claim 9, wherein:

said end bores are wider than said slots.

11. The barrier of claim 2, wherein:

said member has an inner surface taper that extends for a length between said opposed ends that substantially conforms to said tapered surface on said mandrel.

12. The barrier of claim 2, further comprising:

a tapered seal ring abutting said member and on said tapered surface of said mandrel.

13. The barrier of claim 12, wherein:

said tapered seal ring and said member move in tandem to contact the surrounding tubular.

14. The barrier of claim 13, wherein:

said tapered seal ring has a cylindrical outer surface and a tapered inner surface.

15. The barrier of claim 14, wherein:

said seal ring is made of a resilient material.

16. The barrier of claim 15, wherein:

said resilient material is degradable.

17. The barrier of claim 1, wherein:

said member comprises a sealing element that substantially covers said outer surface.

18. The barrier of claim 17, wherein:

said continuous sealing element is made of a resilient degradable material so that structural integrity of said member is undermined in a predetermined time for removal of said member from a location where said member was set against the borehole wall.

19. The barrier of claim 1, wherein:

said member comprises a sealing element that substantially covers an inner surface of said member.

20. The barrier of claim 19, wherein:

said continuous sealing element is made of a resilient degradable material so that structural integrity of said member is undermined in a predetermined time for removal of said member from a location where said member was set against the borehole wall.

21. The barrier of claim 1, wherein:

at least some of said slots have end bores.

22. The barrier of claim 21, wherein:

said end bores are wider than said slots.

23. The barrier of claim 1, wherein:

said member has an inner surface taper that extends for a length between said opposed ends that substantially conforms to said tapered surface on said mandrel.

24. The barrier of claim 1, further comprising:

a tapered seal ring abutting said member and on said tapered surface of said mandrel.

25. The barrier of claim 24, wherein:

said tapered seal ring and said member move in tandem to contact the surrounding tubular.

26. The barrier of claim 25, wherein:

said tapered seal ring has a cylindrical outer surface and a tapered inner surface.

27. The barrier of claim 26, wherein:

said seal ring is made of a resilient material.

28. The barrier of claim 27, wherein:

said resilient material is degradable.

29. A barrier for subterranean use in a borehole, comprising:

a mandrel having at least one tapered surface;

a movable annularly shaped member having opposed ends and circumferentially alternating slots that begin at opposed ends and extend longitudinally;

said member movable relatively with respect to said at least one tapered surface to contact a borehole wall with a smooth outer surface thereof for substantial sealing so that applied differential pressure loading on the barrier can be contained to perform a treating operation;

said member further comprises a continuous groove that circumscribes said outer surface.

30. The barrier of claim 29, wherein:

said groove contains a continuous sealing element.

31. The barrier of claim 30, wherein:

said continuous sealing element is made of a resilient degradable material.

32. A barrier for subterranean use in a borehole, comprising:

a mandrel having at least one tapered surface;

a movable annularly shaped member having opposed ends and circumferentially alternating slots that begin at opposed ends and extend longitudinally;

said member movable relatively with respect to said at least one tapered surface to contact a borehole wall with a smooth outer surface thereof for substantial sealing so that applied differential pressure loading on the barrier can be contained to perform a treating operation;

said member further comprises a continuous groove that circumscribes an inner surface.

33. The barrier of claim 32, wherein:

said groove contains a continuous sealing element.

34. The barrier of claim 33, wherein:

said continuous sealing element is made of a resilient degradable material.

35. A barrier for subterranean use in a borehole, comprising:

a mandrel having at least one tapered surface;

a movable annularly shaped member having opposed ends and circumferentially alternating slots that begin at opposed ends and extend longitudinally;

said member movable relatively with respect to said at least one tapered surface to contact a borehole wall with a smooth outer surface thereof for substantial sealing so that applied differential pressure loading on the barrier can be contained to perform a treating operation;

said member anchors to the borehole wall;

said member further comprises a continuous groove that circumscribes said outer surface.

36. The barrier of claim 35, wherein:

said groove contains a continuous sealing element.

37. The barrier of claim 36, wherein:

said continuous sealing element is made of a resilient degradable material.

38. A barrier for subterranean use in a borehole, comprising:

a mandrel having at least one tapered surface;

a movable annularly shaped member having opposed ends and circumferentially alternating slots that begin at opposed ends and extend longitudinally;

said member movable relatively with respect to said at least one tapered surface to contact a borehole wall with a smooth outer surface thereof for substantial sealing so that applied differential pressure loading on the barrier can be contained to perform a treating operation;

said member anchors to the borehole wall;

said member further comprises a continuous groove that circumscribes an inner surface.

39. The barrier of claim 38, wherein:

said groove contains a continuous sealing element.

40. The barrier of claim 39, wherein:

said continuous sealing element is made of a resilient degradable material.

41. A method of performing a treatment in a subterranean location, comprising:

providing a barrier for subterranean use in a borehole, comprising:

a mandrel having at least one tapered surface;

a movable annularly shaped member having opposed ends and circumferentially alternating slots that begin at the opposed ends and extend longitudinally;

said member movable relatively with respect to said at least one tapered surface to contact a borehole wall with a smooth outer surface thereof that extends for a length from one end of said opposed ends to the other end of said opposed ends for substantial sealing so that applied differential pressure loading on said member the barrier can be contained to perform the treatment;

setting said barrier at a predetermined location against the borehole wall;

performing the treatment against said barrier after said setting.

42. The method of claim 41 comprising:

anchoring said member to the borehole wall.

43. An anchor assembly for subterranean use in a borehole, comprising: a mandrel having at least one tapered surface;

a movable annularly shaped member having opposed ends and circumferentially alternating slots that begin at opposed ends and extend longitudinally;

said member movable relatively with respect to said at least one tapered surface to contact a borehole wall with a smooth outer surface thereof that extends for a length from one end of said opposed ends to the other end of said opposed ends for anchoring so that applied differential pressure loading on the barrier can be resisted to perform a treating operation;

said member is made of a selectively degrading material so that structural integrity of said member is undermined in a predetermined time for removal of said member from a location where said member was set against the borehole wall.

44. The anchor assembly of claim 43, wherein:

said member is made of a controlled electrolytic material.

45. The anchor assembly of claim 43, wherein:

at least some of said slots have end bores.

46. The anchor assembly of claim 45, wherein:

said end bores are wider than said slots.

47. The anchor assembly of claim 43, wherein:

said member has an inner surface taper that extends for a length between said opposed ends that substantially conforms to said tapered surface on said mandrel.

48. The anchor assembly of claim 43, further comprising:

a tapered seal ring abutting said member and on said tapered surface of said mandrel.

49. The anchor assembly of claim 48, wherein:

said tapered seal ring and said member move in tandem to contact the surrounding tubular.

50. The anchor assembly of claim 49, wherein:

said tapered seal ring has a cylindrical outer surface and a tapered inner surface.

51. The anchor assembly of claim 50, wherein:

said seal ring is made of a resilient material.

52. The anchor assembly of claim 51, wherein:

said resilient material is degradable.

53. A method of performing a treatment in a subterranean location, comprising:

providing an anchor assembly for subterranean use in a borehole, comprising:

a mandrel having at least one tapered surface;

a movable annularly shaped member having opposed ends and circumferentially alternating slots that begin at the opposed ends and extend longitudinally;

said member movable relatively with respect to said at least one tapered surface to contact a borehole wall with a smooth outer surface thereof that extends for a length from one end of said opposed ends to the other end of said opposed ends for anchoring so that applied differential pressure loading on the barrier can be resisted to perform the treatment;

said member is made of a selectively degrading material so that structural integrity of said member is undermined in a predetermined time for removal of said member from a location where said member was set against the borehole wall;

setting said anchor assembly at a predetermined location against the borehole wall;

performing the treatment against said barrier after said setting.

* * * * *